US005427381A

United States Patent [19]

Macaluso et al.

[11] Patent Number: 5,427,381

[45] Date of Patent: Jun. 27, 1995

[54] SPORTS NET

[76] Inventors: Anthony G. Macaluso, 2805 Albany Ave., Davis, Calif. 95616; Paul E. Lanham, 22515 Facinas, Mission Viejo, Calif. 92691

[21] Appl. No.: 314,672

[22] Filed: Sep. 29, 1994

[51] Int. Cl.[6] ..... A63B 63/00

[52] U.S. Cl. ..... 273/400

[58] Field of Search ..... 273/57.2, 298, 398, 273/400, 401, 402

[56] References Cited

U.S. PATENT DOCUMENTS

| | | | |
|---|---|---|---|
| 4,373,734 | 2/1983 | Frank | 273/401 X |
| 4,905,996 | 3/1990 | Tallent et al. | 273/401 X |
| 5,244,213 | 9/1993 | Armell | 273/400 |
| 5,246,229 | 9/1993 | Carey | 273/57.2 X |
| 5,277,430 | 1/1994 | Naciarato | 273/400 |
| 5,346,227 | 9/1994 | Amram et al. | 273/400 |

*Primary Examiner*—William H. Grieb

*Attorney, Agent, or Firm*—Lynn & Lynn

[57] ABSTRACT

A portable sports net has an elastic frame. A net support strapping is connected to the frame for supporting a net. The frame with the net attached thereto is foldable into a storage position where it is formed into a plurality of generally concentric rings. Unless the frame is constrained, elastic forces in the frame spontaneously open it to an erected position in which the frame has a base portion, an upper net support portion and a pair of side portions. A pouch is connected to a back surface of the net. A plurality of straps connected between portions of the frame hold it in a predetermined configuration suitable for a hockey goal or the like.

3 Claims, 2 Drawing Sheets

SPORTS NET

BACKGROUND OF THE INVENTION

This invention is directed generally to a net for games such as hockey, lacrosse, soccer or the like. This invention is directed particularly to a net structure that has a foldable, self-erecting elastic frame.

Previous portable net structures either require time-consuming assembly or are heavy and cumbersome to move.

SUMMARY OF THE INVENTION

A portable sports net according to the present invention is formed to include an elastic frame. A net support strapping is connected to the frame and a net is connected to the net support strapping. The frame is Foldable into a storage position where it is formed into a plurality of generally concentric rings. The frame is formed such that elastic forces in the frame spontaneously move the frame to an erected position in which the frame has a base portion, an upper net support portion and a pair of side portions.

The portable sports net according to the present invention may further include a pouch connected to a back surface of the net.

The portable sports net according to the present invention preferably also has a first pair of straps extending between the base and upper net support portions of the frame and a second pair of straps extending between the side portions of the frame. The straps being are formed to restrain the frame to a predetermined configuration suitable for a hockey goal or the like.

An appreciation of the objectives of the present invention and a more complete understanding of its structure and method of operation may be had by studying the following description of the preferred embodiment and by referring to the accompanying drawings.

DESCRIPTION OF THE PREFERRED EMBODIMENT

Figure 1:
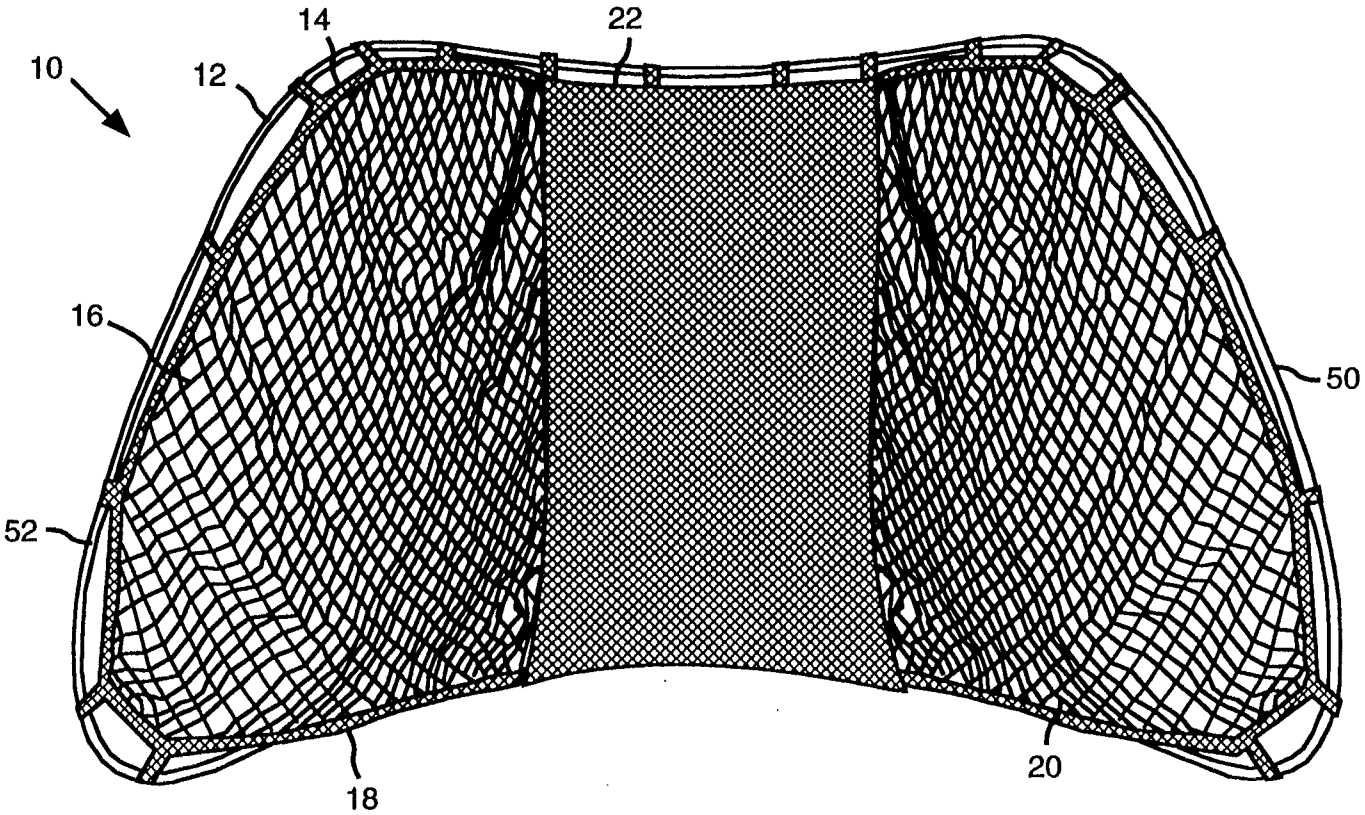
FIG. 1 is a front perspective view of a hockey net according to the present invention.

Referring to FIG. 1, a hockey net 10 according to the present invention includes a frame 12, net support strapping 14 and a net 16. The net 16 may be formed in two sections 18 and 20 with a sheet 22 of fabric, plastic or the like connected between the net sections 18 and 20.

The net support strapping 14 is attached to the frame 12 by a plurality of loops 24 that pass around the corresponding portions of the frame 12. The loops 24 may be formed by stitching or by snap fasteners (not shown) or the like. The net portions 18 and 20 preferably are stitched to the sheet 22. The net portions 18 and 20 and the sheet 22 may be connected to the net support strapping by suitable stitching or by a plurality of straps and loops.

Figure 3:
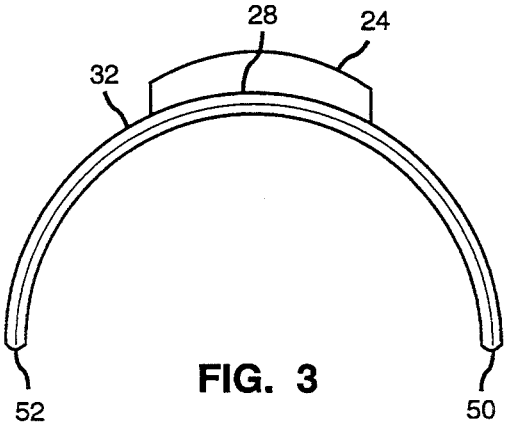
FIG. 3 is a top plan view of the hockey net of FIGS. 1 and 2.
Figure 2:
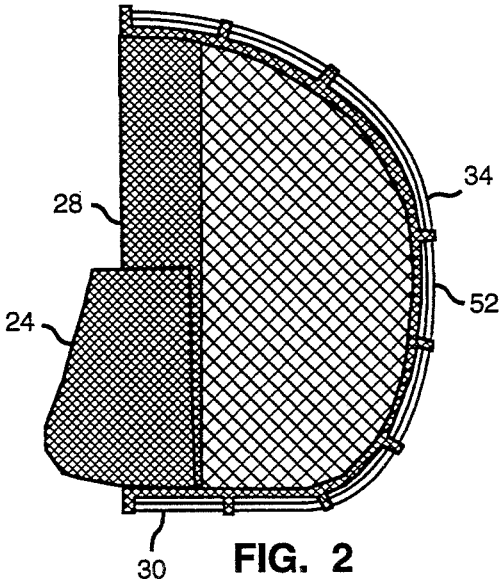
FIG. 2 is a side elevation view of the hockey net of FIG. 1.

Referring to FIGS. 2 and 3, the central sheet 22 preferably includes a pocket or pouch 24. The pouch 24 is preferably formed on the back side 28 of the central sheet 22. The pouch 24 is suitable for holding shoes or the like. The pouch 24 may also hold a weight such as a sand bag (not shown) or the like to provide stability to the net while it is in use.

Figure 4:
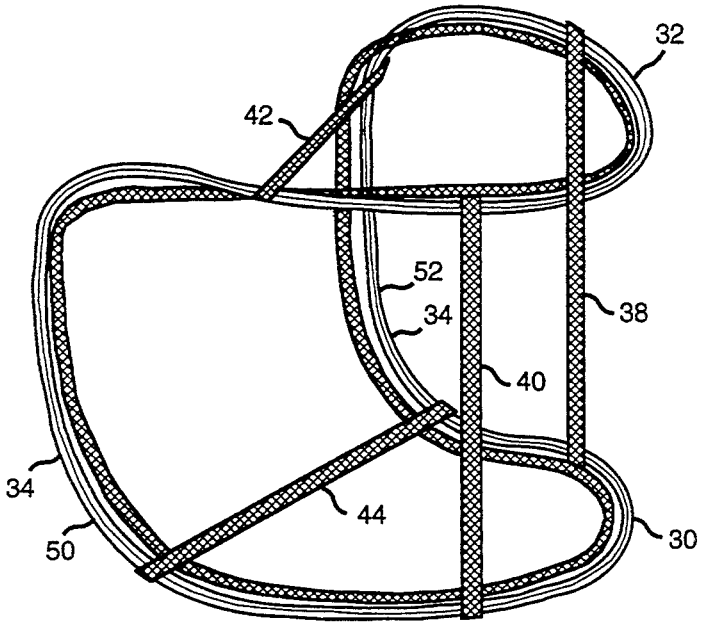
FIG. 4 is a perspective view of a frame and net support straps that may be included in the hockey net of FIGS. 1–3.

Referring to FIG. 4, the frame 12 preferably is formed of a single length of spring wire or the like. The ends of the wire are connected together to form a continuous loop. The spring wire frame 12 may be formed to have a memory for the erected configuration shown in FIGS. 1–3. The frame 12 thus includes base portion 30, an upper net support portion 32 and a pair of side support portions 34 and 36. A pair of straps 38 and 40 extends between the base portion 30 and the net support portion 32. The ends of the straps 38 and 40 are connected to the frame 12 so that they maintain a predetermined spacing between the base portion 30 and the net support portion 32. A pair of straps 42 and 44 extends between the side support portions 34 and 36. The ends of the straps 42 and 44 are connected to the frame 12 so that they maintain a predetermined spacing between the side support portions 34 and 36. The spring steel frame 12 exerts tensile forces on the straps 38, 40, 42 and 44, which prevent the net from being subject to the force of the spring wire frame 12.

The straps 38, 40, 42 and 44 constrain the frame 12 to a predetermined configuration in which the net 10 has closed back and side areas and an open mouth area. When in use for street hockey or the like, the open mouth area is arranged to face the field of play.

Figure 5:
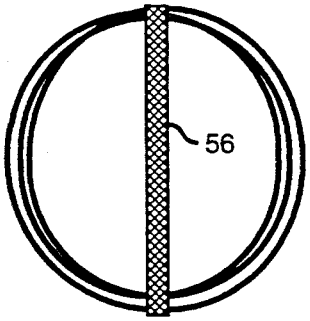
FIG. 5 illustrates the frame in its stored position.
Figure 6:
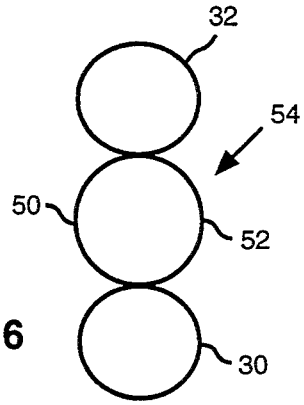
FIG. 6 illustrates folding the hockey net from the erected position to the storage position.

Referring to FIGS. 4 and 6, the frame 12 may be coiled into three essentially concentric generally circular portions. The frame is folded into its storage position as shown in FIG. 5 by grasping the front edges 50 and 52 of the side portions 34 and 36 and crossing one over the other to form a loop 54 between the base 30 and net support loop 32. The base loop 30 and the net support loop 32 are then folded toward the plane of the loop 54. A strap 56 may then be used to secure the three loops together. It should be understood that the process of folding the frame to form the three loops is performed with the net attached to the frame 12.

The net 10 is erected by releasing the strap 56 and allowing the spring force of the frame 12 to restore the frame 12 to the erected position of FIGS. 1 and 2.

The structures and methods disclosed herein illustrate the principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. A portable sports net, comprising:

an elastic frame;

a net support strapping connected to the frame;

a net connected to the net support strapping, the frame being foldable into a storage position where it is formed into a plurality of generally concentric rings, the frame being formed such that elastic forces in the frame spontaneously move the frame to an erected position in which the frame has a base portion, an upper net support portion and a pair of side portions.

2. The portable sports net of claim 1 further comprising a pouch connected to a back surface of the net.

3. The portable sports net of claim 1 further comprising:

a first pair of straps extending between the base and upper net support portions of the frame; and a second pair of straps extending between the side portions of the frame, the first and second pairs of straps being formed to restrain the frame to a predetermined configuration suitable for a hockey goal.

* * * * *